US009458658B2

(12) United States Patent
Stavenjord

(10) Patent No.: US 9,458,658 B2
(45) **Date of Patent: *Oct. 4, 2016**

(54) CASING SYSTEM

(71) Applicant: Walter Karl Stavenjord, Claresholm (CA)

(72) Inventor: Walter Karl Stavenjord, Claresholm (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/454,454

(22) Filed: Aug. 7, 2014

(65) Prior Publication Data

US 2014/0345214 A1 Nov. 27, 2014

Related U.S. Application Data

(63) Continuation of application No. 13/961,550, filed on Aug. 7, 2013, now Pat. No. 8,833,038, which is a continuation of application No. 10/675,548, filed on Sep. 30, 2003, now abandoned.

(51) Int. Cl.

| | |
|---|---|
| ***B44C 1/00*** | (2006.01) |
| ***E04F 19/02*** | (2006.01) |
| ***E06B 1/34*** | (2006.01) |
| ***E06B 1/06*** | (2006.01) |
| ***E06B 3/984*** | (2006.01) |
| ***E04B 1/38*** | (2006.01) |
| *E06B 3/70* | (2006.01) |
| *E04F 19/04* | (2006.01) |
| *E06B 3/988* | (2006.01) |
| *B44C 1/28* | (2006.01) |

(52) U.S. Cl.

CPC . *E06B 1/34* (2013.01); *E04B 1/38* (2013.01); *E04F 19/02* (2013.01); *E04F 19/0495* (2013.01); *E06B 1/06* (2013.01); *E06B 3/7001* (2013.01); *E06B 3/984* (2013.01); *B44C 1/28* (2013.01); *E04F 19/04* (2013.01); *E06B 3/70* (2013.01); *E06B 3/988* (2013.01)

(58) Field of Classification Search

CPC ..... E04F 13/08; E04F 13/072; E04F 13/00; E04F 19/04; E04F 19/02; E04F 19/0495; B44C 1/005; B44C 1/00; B44C 1/28; E06B 3/988; E06B 3/70; E06B 1/34; E06B 1/06; E06B 3/7001; E06B 3/984; E04B 1/38

USPC ..... 52/574, 573.1, 311.1, 311.2, 747.11, 52/747.12, 747.1, 316

See application file for complete search history.

(56) References Cited

U.S. PATENT DOCUMENTS

| | | | | | |
|---|---|---|---|---|---|
| 3,609,927 | A | * | 10/1971 | Wine | E04F 19/02 52/100 |
| 4,471,012 | A | * | 9/1984 | Maxwell | B32B 21/13 144/347 |
| 4,814,953 | A | * | 3/1989 | Distasio | 362/147 |
| 5,179,811 | A | * | 1/1993 | Walker | E04F 19/0436 52/288.1 |
| 5,199,237 | A | * | 4/1993 | Juntunen | 52/287.1 |
| 5,359,817 | A | | 11/1994 | Fulton | |
| 6,148,883 | A | | 11/2000 | Wilson | |

(Continued)

FOREIGN PATENT DOCUMENTS

FR 2410118 A1 6/1979

*Primary Examiner* — Phi A

(57) ABSTRACT

A casing system for covering the edges of structural frameworks and the like. The system includes a first casing piece and a second casing piece shaped to fit together. The first casing piece has a decorative profile milled into at least one side or end edge. The second casing piece has a reverse image of the decorative profile milled into a side or end edge. The pieces fit together by abutting edges or sides having a decorative profile and the reverse image of the decorative profile.

17 Claims, 8 Drawing Sheets

(56) References Cited

U.S. PATENT DOCUMENTS 6,202,380 B1 * 3/2001 Trutwin ..... E04F 19/0468 174/504

7,784,233 B2 * 8/2010 Friedlich ..... E04F 19/0436 52/287.1

2006/0260248 A1 * 11/2006 Questel ..... E04F 19/0436 52/578

* cited by examiner

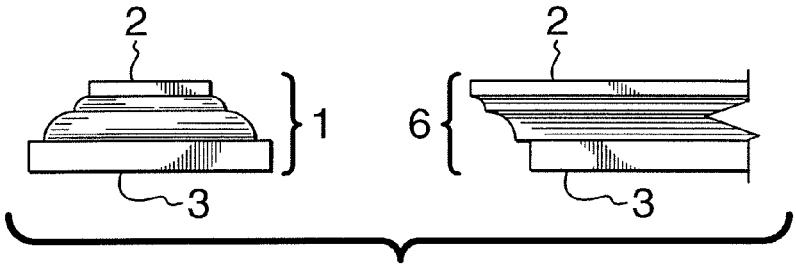
FIG. 3A
FIG. 3B
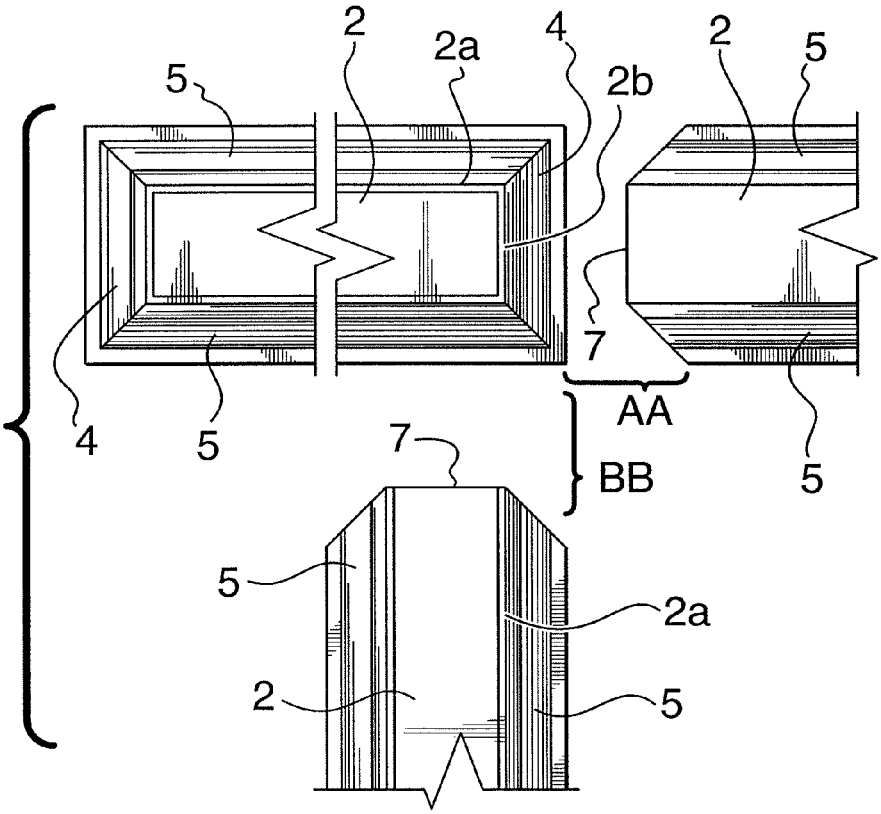

CASING SYSTEM

CROSS-REFERENCE TO RELATED APPLICATIONS

This application is a continuation of U.S. application Ser. No. 13/961,550 filed on Aug. 7, 2013, which was a continuation of U.S. application Ser. No. 10/675,548, filed on Sep. 30, 2003, now abandoned.

FIELD OF THE INVENTION

This invention relates to decorative casing trim and, more particularly, to prefabricated casing trim of the kind used to finish structural openings and to construct decorative elements on walls and ceilings of commercial and residential buildings and structures.

BACKGROUND ART

Structural openings in the walls of commercial and residential buildings include openings provided to enable the installation of doors, windows, passageways and recessed areas for bookcases, shelves, niches and the like. The framing of such openings during building construction allows sufficient space to enable precise positioning, adjustment and final alignment, then fastening of doors, windows and other elements during installation. Door and window units come in standardized sizes to simplify the installation processes, and are often provided with attached frames that simplify the installation of such units into framed structural openings. However, when such units are installed into structural openings, permanent gaps often appear between the structural framework and the abutting surfaces of the frames surrounding the units as a consequence of precise vertical and horizontal alignment of the units within, and fastening to, the structural openings.

It is common construction practice to cover the gaps between the framework of structural openings and installed units with trim mouldings, also commonly known and referred to hereinafter as casings. These are usually elongated relatively thin flat pieces of trim bounded by elongated linear side edges and shorter linear end edges. It is also common practice to have decorative profiles cut into at least one linear edge of casing pieces to enhance the visual appeal of the casings. Such decorative profiles can be simple or complex depending on the type of aesthetically pleasing appearance desired. The process of cutting decorative profiles into the edges of casing pieces is commonly known as milling.

Casing pieces with aesthetically pleasing decorative profiles milled into their linear edges are often used to construct other decorative elements in commercial and residential structures. Such decorative elements include chair railings, wainscoting, borders around the perimeters of walls and ceilings, and the like. However, installation of casings to conceal the gaps between installed units and the framework of structural openings, and to produce other decorative design elements on walls and ceilings, is time consuming and requires considerable skill and precision to achieve aesthetically pleasing results.

There are two common methods for installation of casings. The first method involves fitting together the individual vertical and horizontal casing pieces surrounding a structural opening by means of mitre joints wherein each end of a casing piece is cut precisely at a 45° angle to enable the formation of a tightly fitted and squared 90° corner. If the end-cuts are not precisely made with 45° angles, then visually displeasing small gaps will result in the mitred corners that join the vertical and horizontal casing pieces. In these cases, even more construction time is required to fill the gaps with a suitable putty or other filling compound, to allow the filling compound to harden, and then to remove excess filling compound by sanding to eliminate the gaps. As the complexity of the design milled into the linear edge of casing pieces increases, the difficulty of precisely cutting and fitting mitred corners is increased.

The second method involves installation of square blocks at the top corners around units such as doors and windows in a manner that bridges the gap between the units and the framework of the structural openings. The ends of the individual horizontal and vertical casing pieces are cut at precise 90° angles and are then tightly butted against the corner blocks. However, the second method is also time-consuming and requires considerable skill and precision to ensure that the corner blocks are perfectly squared and vertically aligned. Misalignment or un-squared corners will result in aesthetically unappealing gaps between the casing pieces and corner blocks. These gaps must also be filled with an appropriate filling compound that has been sanded after it has hardened.

An additional problem encountered when installing decorative casing pieces is that of joining vertical and horizontal casings which have different decorative profiles milled into their edges. One example of such a situation is the joining of a vertical casing piece to a horizontal casing piece installed in a vertical orientation at the juncture of a wall with a floor. In these situations, the decorative profile milled into the linear edge of one casing piece must be traced onto a paper pattern that is then transferred to the receiving edge of a casing piece with a different decorative profile milled into its linear edge. The first decorative profile is then cut into the second decorative profile by means of a coping saw. This process requires considerable skill, precision, time and patience in order to produce tightly fitting joints between adjoining casing pieces.

Because of their decorative properties, casings are also commonly used for installation of aesthetically appealing chair rails, wainscoting and other decorative elements on walls and ceilings. The vertical and horizontal casing pieces used to create such decorative trim work are abutted and joined by means of mitre joints. Consequently, the installation process for casing pieces used for decorative trim work is also time consuming and requires skill, precision and patience to produce tightly fitting squared joints.

There is therefore a need for an improved system for assembling and installing casing pieces that avoids at least some of the problems indicated above.

SUMMARY OF THE INVENTION

Accordingly, it is an object of the present invention, at least in its preferred forms, to simplify the process of installing decorative casing pieces to cover the gaps between the framing of structural openings and installed amenities such as doors, windows and the like.

According to one aspect of the present invention, there is provided a casing system, comprising a generally flat first casing piece having an outer face, an inner face, a pair of linear side edges and a pair of linear end edges, at least one of the linear side edges and at least one of the linear end edges being provided with a continuous decorative profile; and a second casing piece having an outer face, an inner face, a pair of linear side edges and a pair of linear end edges, at least one of the linear end edges being provided with a reverse image of the continuous decorative profile; whereby the first casing piece is adapted to be joined to the second casing piece by engagement of the continuous decorative profile of the first casing piece with the reverse image of the decorative profile of the second casing piece.

By the term decorative profile, I mean that a side edge or end edge (when viewed in cross-section) has a sloping surface extending from the outer face of the piece to the inner face of the piece. The sloping surface has a non-linear profile that preferably has at least two stages, each provided with a decorative profile. The decorative profile may be one of, or a combination of, a straight linear surface, a curved convex surface, or a curved concave surface.

It is important to note that the decorative profile, and the reverse image of the decorative profile, are both pre-formed on the first and second decorative pieces as the pieces are manufactured and before they are sold and used. The present invention therefore requires no shaping and precision cutting of decorative surfaces onto casing pieces as such pieces are being installed in buildings and the like.

While it is preferred to provide a decorative profile on both side edges and both end edges of the first casing piece of the present invention, this is not essential. The system can still be used to advantage if the first casing piece is provided with the decorative profile on at least one side edge or at least one end edge, although the versatility of the system is then reduced.

Similarly, while it is preferred to provide the reverse image of the decorative profile on both end edges of the second casing piece, this is not essential and the reverse image may be provided on one end edge only. The side edges of the second casing piece may have no decorative profile (if desired) or a different decorative profile from that used on the first casing piece, although it is preferred to provide both side edges of the second casing piece with the same decorative profile as that used on the first casing piece.

The present invention, at least in its preferred forms, can provide a system for producing and installing decorative casing pieces that does not require precise measurement and cutting of mitre joints to tightly fit adjoining or abutted casing pieces together, and thereby greatly reduces construction time required for installation of casings in residential and commercial buildings, yet enables fabrication of tightly fitted and aesthetically pleasing joints between abutted and joined casing pieces. The invention also relates to a kit of parts forming a casing system, preferably with instructions for assembly of the parts. The instructions include options for assembly as explained herein.

Other aspects and features of the present invention will become apparent to those skilled in the art upon review of the following description of specific embodiments of the invention that are described in conjunction with the accompanying drawings.

BRIEF DESCRIPTION OF THE DRAWINGS

FIGS. 3A, 3B, 3C and 3D show ways in which the pieces previously shown can be fitted together, FIG. 3A being an exploded side elevational view, FIG. 3B being an exploded top plan view; FIG. 3C being a perspective view of assembled pieces, and FIG. 3D being a view similar to FIG. 3C, but with the pieces aligned differently;

DETAILED DESCRIPTION OF THE INVENTION

Figure 1A:
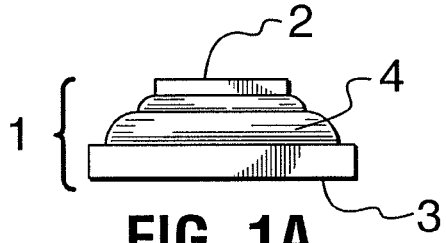
FIGS. 1A, 1B, 1C and 1D show different views of a first casing piece according to a preferred embodiment of the invention, FIG. 1A being a side elevation from one end of the piece, FIG. 1B being a top plan view, FIG. 1C being a side elevation from one side of the piece, and FIG. 1D being a perspective view from above and to one side.
Figure 1B:
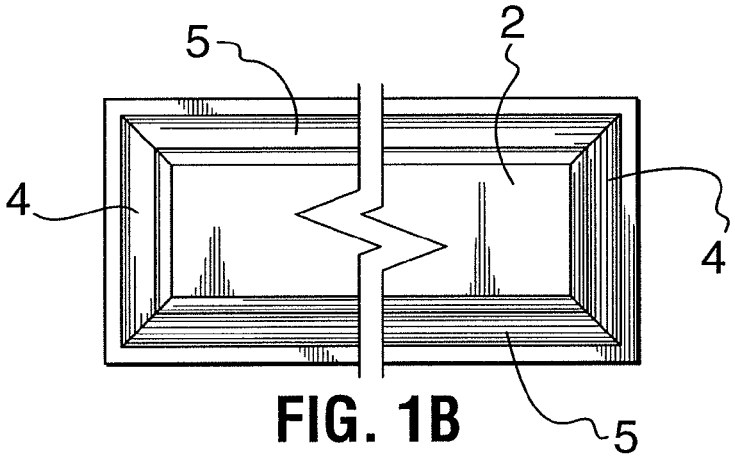
Figure 1C:
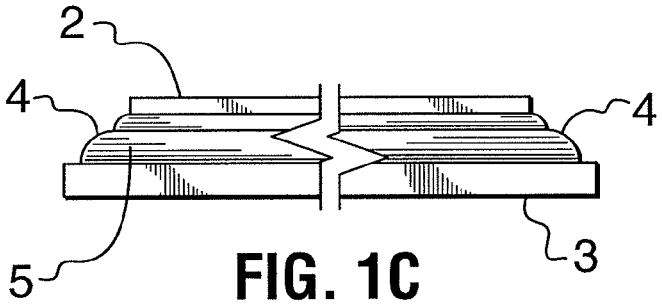
Figure 1D:
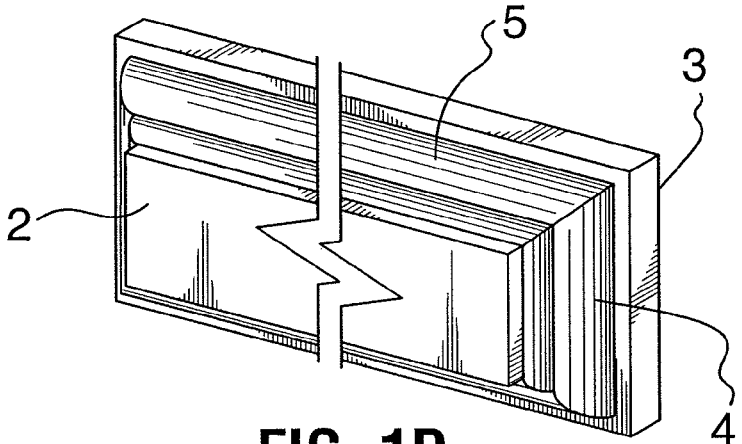
Figure 2A:
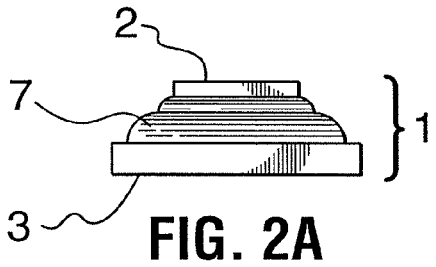
FIGS. 2A, 2B, 2C and 2D show different views of a second casing piece according to a preferred embodiment of the invention, FIG. 2A being a side elevation from one end of the piece, FIG. 2B being a top plan view, FIG. 2C being a side elevation from one side of the piece, and FIG. 2D being a perspective view from above and to one side.
Figure 2B:
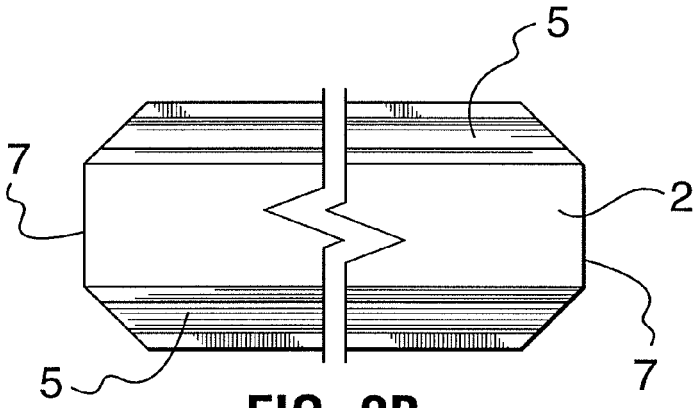
Figure 2C:
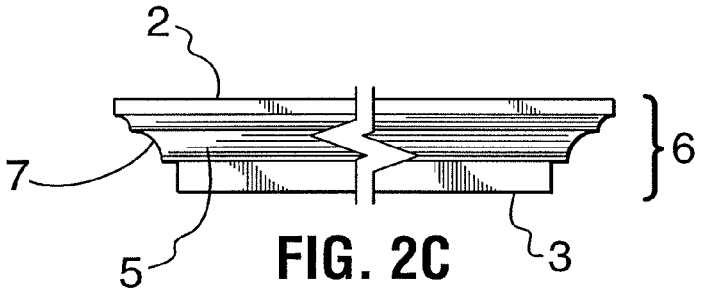
Figure 2D:
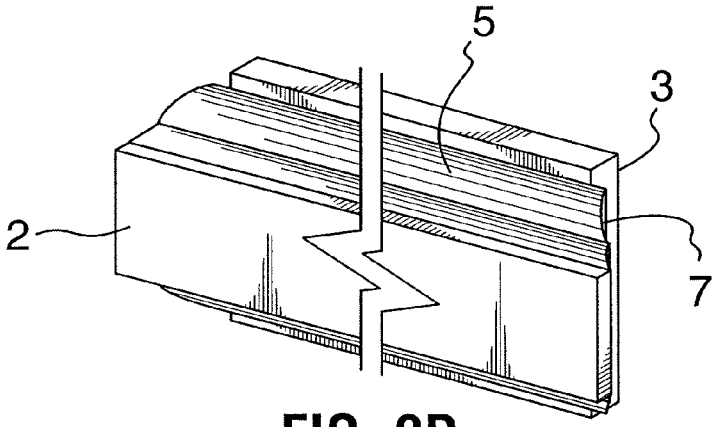

First of all, it should be noted that, throughout the several views of the accompanying drawings, similar elements of different parts of the equipment are identified by the same reference numerals for the sake of simplicity and ease of understanding.

The decorative casing system of the present invention can be used for quickly and easily covering the gaps between the framework of structural openings and installed units, and for creating decorative features on walls and ceilings of commercial and residential structures.

In its simplest form, the invention consists of two casing pieces. An example of a first casing piece (casing piece A) is shown in FIGS. 1A to 1D and an example of a second casing piece (casing piece B) is shown in FIGS. 2A to 2D. These pieces are designed to fit and work together.

As shown in FIGS. 1A to 1D, casing piece A is in the form of an elongated flat strip of material such as wood or plastics. The piece has a generally flat top surface 2, a generally flat bottom surface 3, relatively short linear end edges 4 and elongated linear side edges 5. The piece has a continuous decorative design profile 1 milled into the two linear edges 5, and the two end edges 4.

As shown in FIGS. 2A to 2D, casing piece B has a generally flat top surface 2, a generally flat bottom surface 3, relatively short linear end edges 4 and elongated linear side edges 5. The two linear side edges 5 have the same decorative profile 1 as that of the side edges 5 of casing piece A. However, the linear end edges 7 of casing piece B have a milled decorative design profile 6 that is the exact reverse image of the design 1 of the end edges 7 of casing piece B. The surfaces the reverse profile 6 milled into the end edges 7 of casing piece B are engagement surfaces that contact and engage the equivalent surfaces of the continuous design profile 1 milled into the linear edges 5 and/or end edges 4 of the type of casing piece A. This is exemplified in FIGS. 3A to 3D.

Accordingly, the engagement surfaces of the decorative design reverse profile 6 at the end edges 7 of casing piece B contact and tightly engage the continuous decorative design profile 1 milled into the end edges 4 of casing piece A as shown at AA in FIG. 3B, to provide extended conjoined length of casing with an uninterrupted continuous decorative design profile along its linear and end edges.

Figure 3C:
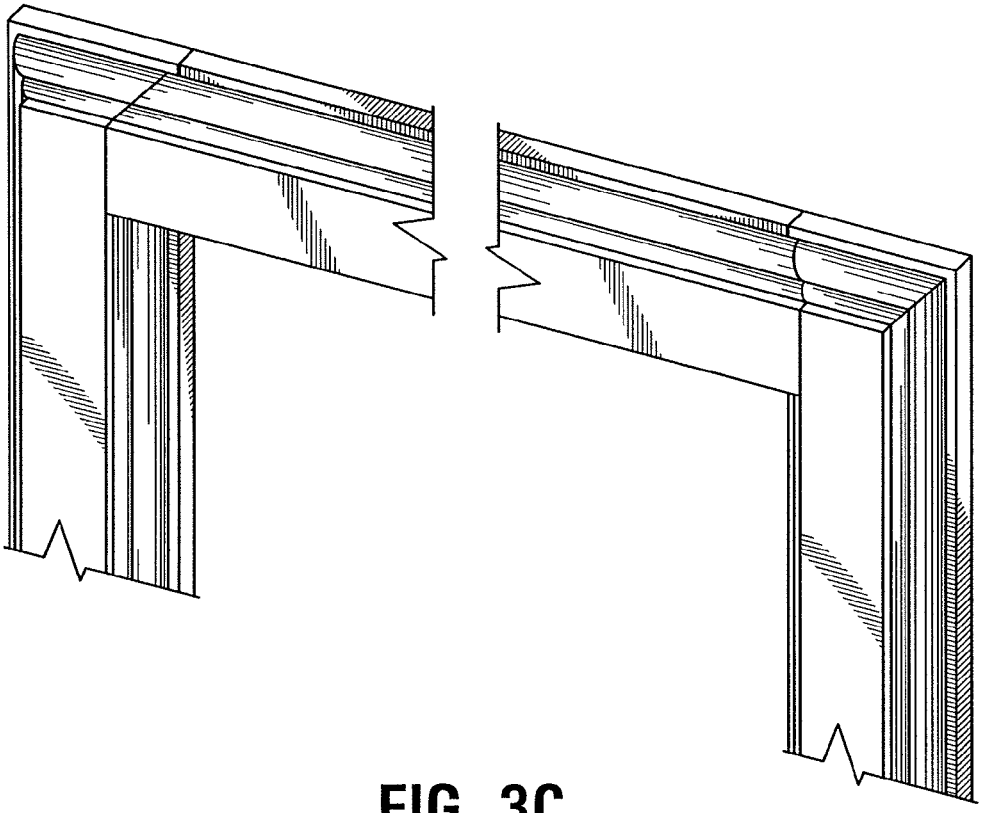

Alternatively, the engagement surfaces of the decorative design reverse profile 6 at the end edges 4 of casing piece B, may contact and tightly engage the decorative design profile 1 milled into the linear side edges 5 of casing piece A as shown at point BB in FIG. 3B, to provide a tightly fitting and aesthetically pleasing precise 90° joint between casing pieces A and B. Referring to FIG. 3B, it is preferred to align the outside linear margin 2*a* of the top surface 2 of casing piece B with the end top margin 2*a* of casing piece A to produce a tightly fitted and aesthetically pleasing 90° joint that has the appearance of a precisely constructed mitre joint as shown in FIG. 3C.

Figure 3D:
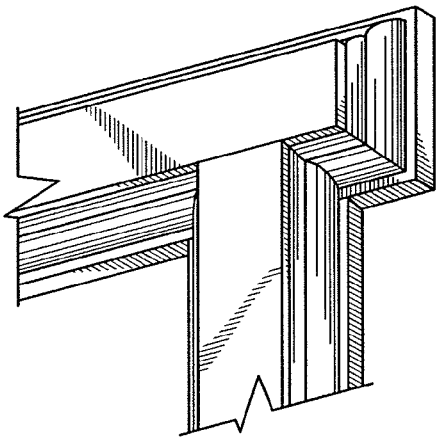

Another feature of this invention is that the point of contact between the end edge 7 of casing piece B and linear edge 5 of casing piece A can be made at any point along the length of casing piece A, or at any point along the length of an extended casing piece made up of several conjoined casing pieces A and B as shown in FIG. 3D. Furthermore, the point of contact between the end edge 7 of casing piece B can be made with the linear edge 5 of another identical casing piece B (not shown).

Such alignment, contact and engagement of decorative design profiles milled into linear edges of casing pieces with their exact reverse profiles milled into the end edges of other casing pieces can be carried out quickly and simply without the need for the time and skill required for precise measurement, cutting and fitting of two individual casing pieces to surround window or door units, or the like, installed into structural openings, and for decorative designs on walls and ceilings and, thus, represents a significant advantage over the current practices.

Figure 4:
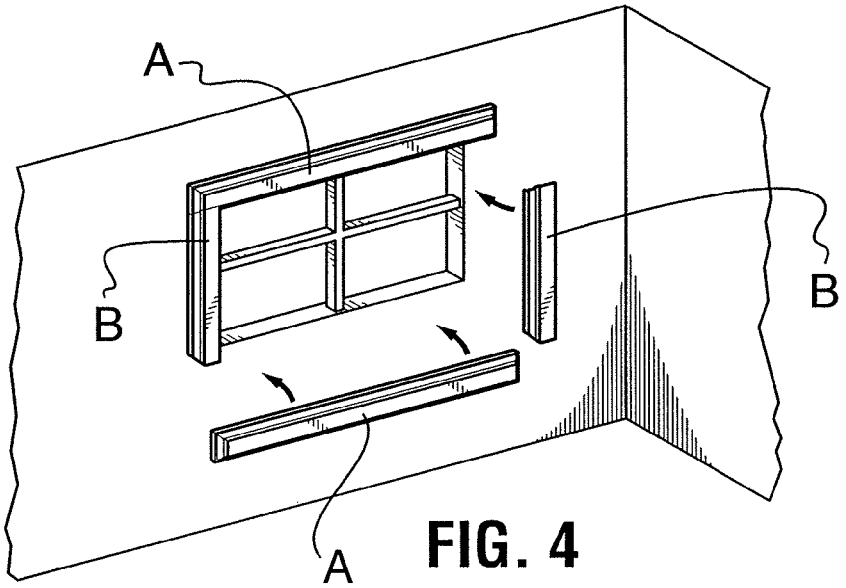
FIG. 4 is a perspective view of a window opening showing casing pieces according to the invention assembled therearound, with some of the pieces shown in exploded positions.

Precise measurements and mitre cuts into the ends of the casing pieces in order to tightly fit them around installed units, such as windows and doors, are not required with the present invention. An example of this is shown in FIG. 4 which is an illustration of how the present invention can be used to quickly and simply install decorative casing pieces to cover the gaps between a structural opening and a window frame of an installed window unit. An appropriate length of casing piece A that has a continuous decorative design milled into its linear edges and end edges, is selected and placed in a horizontal orientation in a manner that contacts the vertical surfaces of the top part of the window frame and the framework of the structural opening into which the window was installed and bridges the gap between top part of the window frame and the framework of the structural opening. The horizontal positioning of casing piece A is then levelled into a horizontal with the aid of an appropriate instrument (e.g. a spirit level) after which, the casing piece A is fastened to both the window frame and the framework of the surrounding structural opening. The next step is to select an appropriate length of casing piece B that has a decorative reverse image 6 milled into its end edge 4 that corresponds with the continuous decorative profile milled into the edges of the installed casing piece A. Casing piece B is installed along one vertical edge of the installed window to cover the gap between the window frame and the surrounding framework such that the end edge 4 of casing piece B is contacted with the linear edge 5 of casing piece A such that the outside linear margin 2*a* of the top surface of casing piece B is aligned with the end top margin 2*a* of casing piece A, then engaged to produce a tightly fitted and aesthetically pleasing 90° joint that has the appearance of a precisely constructed mitre joint as shown in FIG. 3C. Casing piece B is then securely fastened to the window frame and surrounding framework. An additional casing piece B is attached vertically on the other side of the installed window in a similar fashion. The final step is to attach another casing piece A horizontally at the base of the installed window by first contacting its upper linear edge 5 with the end edges 4 of the two vertically installed casing pieces B, then fully engaging and tightly abutting the casing piece A against the two vertically installed casing pieces B, after which the additional casing piece A is fastened to the lower edge of the window frame and surrounding framework.

The same approach may be used to install decorative casing to cover the gaps between a structural opening and the frame of an installed door and other such units, and at the juncture of walls with floors. If so desired, the casing pieces A selected for securing to the top parts of the door frame may be longer than the structural opening so that the ends of the casing piece A extend beyond the contact points of the two vertical casing pieces B as shown in FIG. 3D. This produces an appealing design effect.

Figure 5:
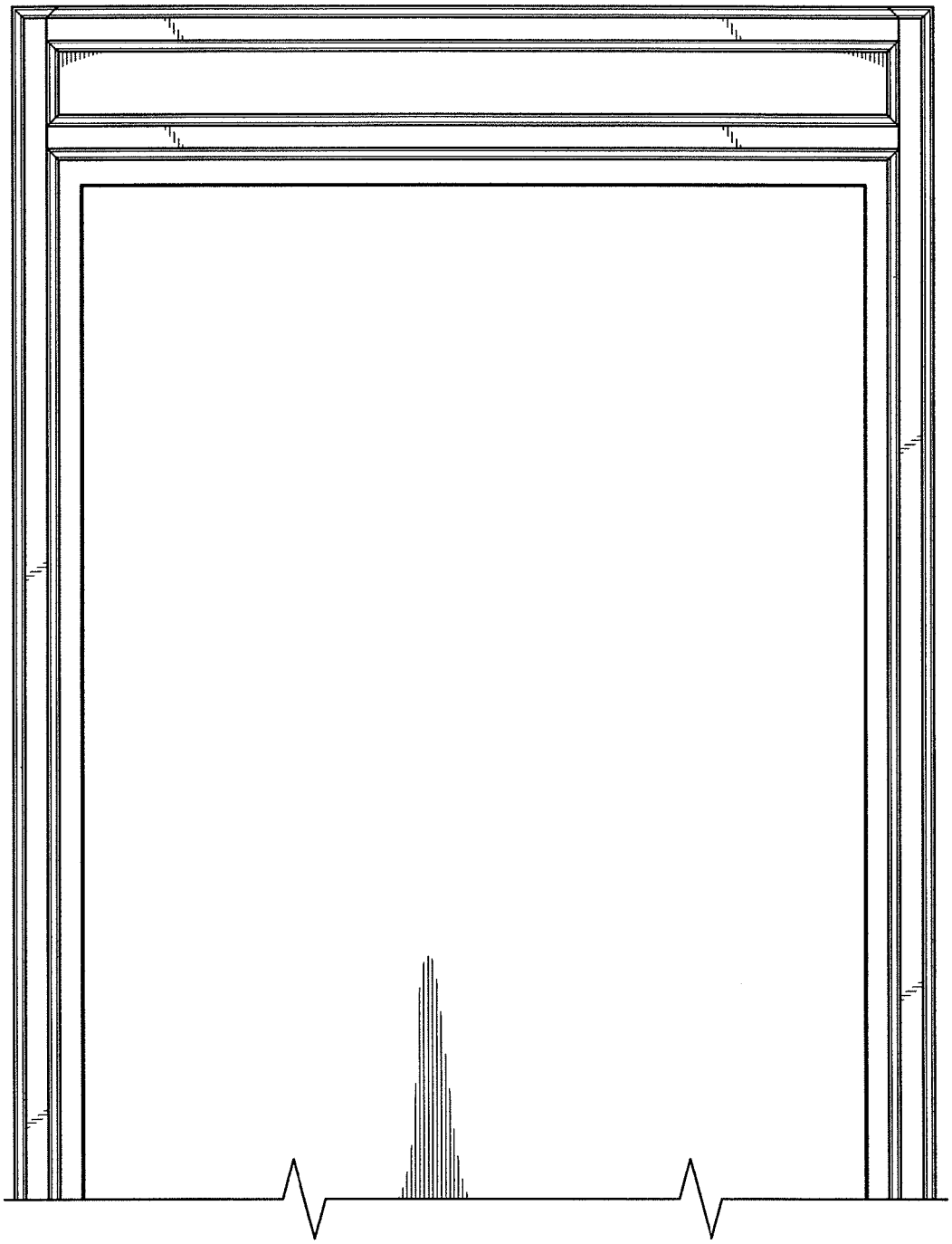
FIG. 5. is a perspective view of casing pieces according to one aspect of the present invention installed at one side of a door opening.

It is not necessary to install casing pieces A horizontally and casing pieces B vertically in order to practice the invention. The same aesthetically pleasing results can be produced by installing casing pieces A along the vertical sides of installed units and installing casing pieces B along the horizontal sides. If casing pieces A are installed in a vertical orientation, they can be selected, if so preferred, to extend a predetermined distance beyond the top of structural framework. In this case, a casing piece B will be fastened to the top part of the unit's frame and the surrounding framework and tightly abutted against the two vertical casing pieces A, and a second casing piece B will be used to cap the two vertical casing pieces A as shown in FIG. 5.

Figure 6:
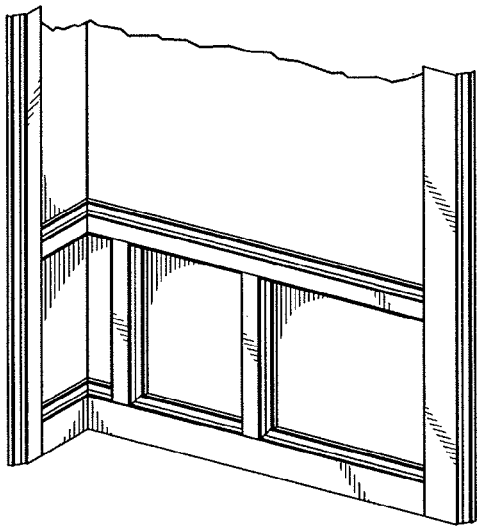
FIG. 6 is a front elevation of casing pieces according to the present invention used to produce wainscoting on a wall.

Casing pieces A and B may be additionally used to produce aesthetically pleasing functional designs on walls, i.e. for creating items such as chair railings and wainscoting as illustrated in FIG. 6. In such cases, an upper horizontal element of wall design features, such as chair rails and wainscoting, is attached to a vertical casing piece which has a decorative design profile 1 milled into its linear edge 5 and is surrounding an installed element such as a window or door, by means of contacting and engaging a horizontally orientated casing piece B by its end edge 7 with the reverse image 6 with the linear edge 5 of the vertical casing piece. The upper horizontal element of the wall design feature is extended to the next vertically installed casing with the same continuous decorative design profile milled into its linear edge 5, by conjoining casing pieces A and B which have corresponding positive and reverse design profiles milled into their end edges. If so desired, vertical elements can be added to wall design features such as chair rails and wainscoting by adjoining selecting lengths of casing pieces B by their end edges 7 to the linear edges 5 of upper horizontal casings and casings used at the junctures of walls and floors.

It should be noted that this invention is not restricted to a particular type or complexity of the design profiles milled into the linear and end edges of casing pieces. Rather, it is important that a selected design profile is continuously formed into the linear edges of casing pieces, and that preferably the same design profile is milled into some but not all of the end edges of the casing pieces. It is necessary for some of the end edges of the casing pieces to be milled with the exact reverse image of the continuous design profile, and it is this feature that provides the means by which casing pieces can be easily, simply, and quickly adjoined or abutted together to produce tightly fitting aesthetically pleasing joints and corners.

Figure 7A:
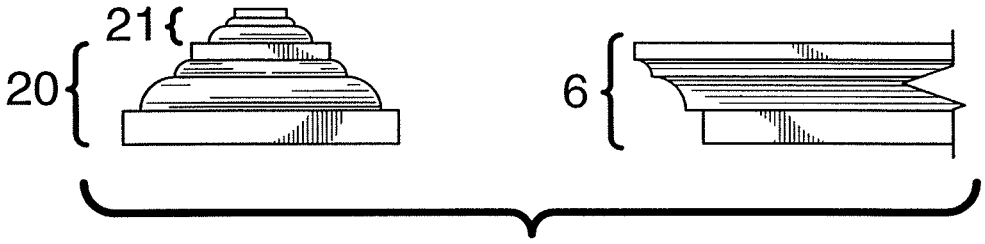
FIGS. 7A, 7B and 7C show three aspects of yet another preferred embodiment of this invention for simplified joining and abutting individual casing pieces with different amounts of decorative profiles milled into their linear edges, FIG. 7A being a side elevation, FIG. 7B being a top plan view and FIG. 7C being a perspective view.
Figure 7B:
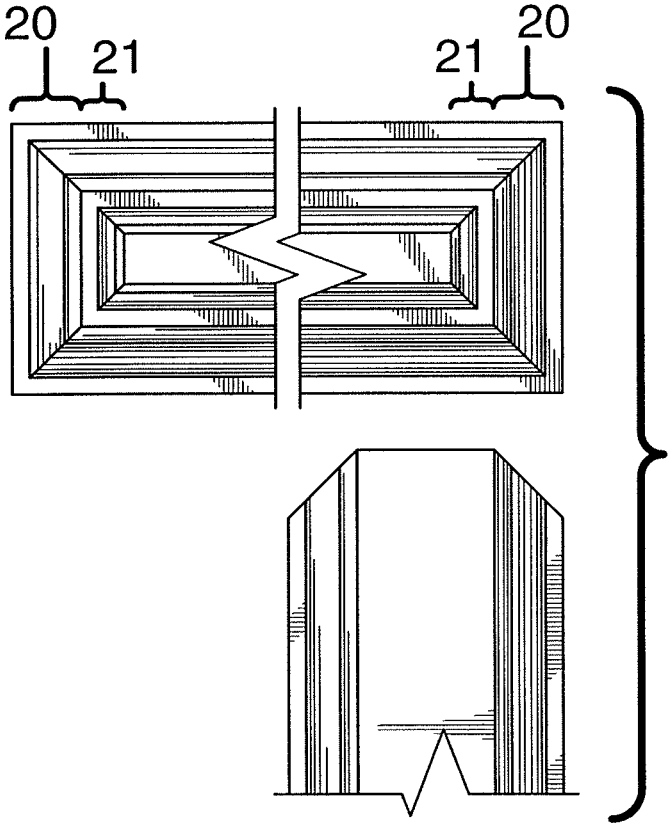
Figure 7C:
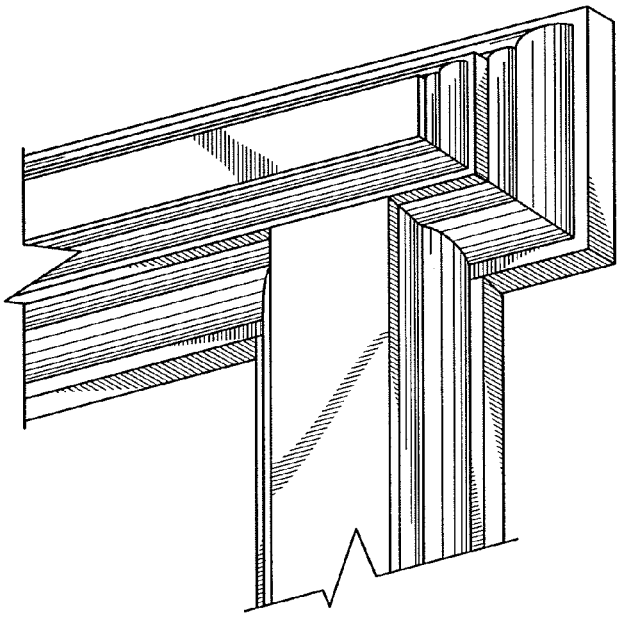

Another embodiment of the present invention relates to a method of further enhancing the aesthetic appearance of the continuous decorative casing systems by increasing the dimensional thickness of selected casing pieces of the type referred to as casing pieces A, by stacking a second type of casing piece A wherein the outer width of the second casing piece A will fit within the top surface margins for the first casing piece A as shown in FIGS. 7A, 7B, and 7C, said enhanced casing piece A referred to hereinafter as a raised casing piece A. FIG. 7A is an end view of the raised casing piece A, FIG. 7B is a top view, and FIG. 7C is a perspective view of the raised casing piece A with an abutting casing piece B. It is necessary that the continuous decorative profile milled into the linear and end edges of the lower section 20 of the raised casing piece A matches exactly the reverse image milled into the end edges 6 of casing pieces that will abut or adjoin to the raised casing piece A. The continuous decorative profiles milled into the raised linear and end edges of raised casing pieces A can match, but do not have to match the continuous decorative profiles milled into the lower linear and end edges of the raised casing edges A. It is only essential that the decorative profiles milled into the lower linear and end sections of the raised casing pieces A match the reverse images milled into the ends of casing pieces that will be abutted to the raised casing pieces A. It is preferred that raised casing pieces A are used for installation at the upper horizontal junctures of installed amenities with framework of structural openings such as doors and windows. Alternatively, raised casing pieces A can be produced as squares for installation of aesthetically pleasing designs on walls and ceilings wherein casing pieces B are abutted into two or more of the sides of the raised casing pieces A.

Figure 8:
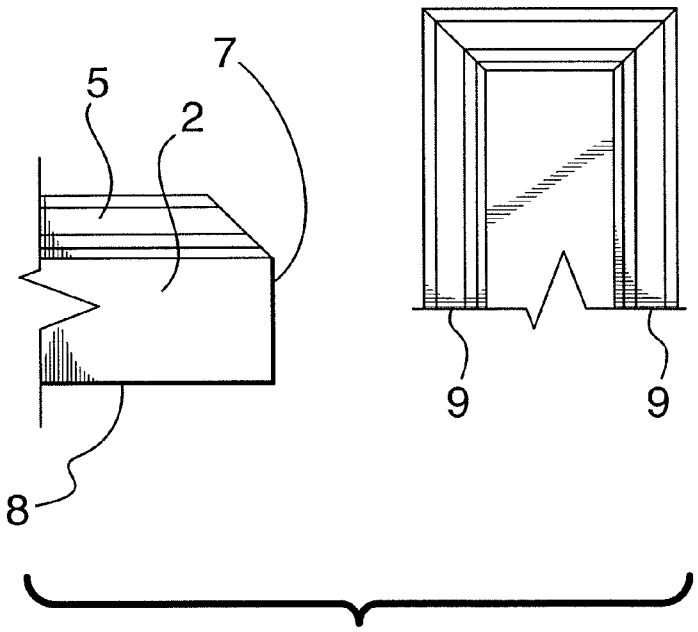
FIG. 8 is a side elevation showing another preferred embodiment of this invention illustrating modifications to the linear edges and end edges of the casing pieces to simply the installation of decorative casing at the junctures of walls, floors, and structural openings encompassing door frames.

The preferred embodiments of this invention exemplified in FIGS. 1A to 1D and FIGS. 2A to 2D can be modified to provide alternative choices for attaching casing pieces with continuous decorative edges to door frames and at the junctures of walls and floors, and walls and ceilings wherein one linear edge 8 may not be milled with the design but left with 90° corners between the top, side, and bottom edges as shown in FIG. 8. The straight linear edge 8 of such a casing piece shown in FIG. 8 can be used to contact the floor or ceiling while the linear edge with the continuous design 5 contacts the wall. It is also an option to have one end edge 9 of the casing pieces without a positive or reverse image of a decorative profile milled, but rather, left with 90° corners between the top, side, and bottom edges. Such a casing piece can be used to vertical installation to cover the gaps between installed door frames and the surrounding structural framework, and to contact and abut the floor with the straight un-milled end edge 9 as shown in FIG. 8.

While the preferred embodiments have been shown, illustrated and described, it will be apparent to those skilled in this field that various modifications can be made in these embodiments without departing from the spirit of the present invention. Therefore, while the following claims define the embodiments in a particular way, any combination of one or more of these embodiments is contemplated according to the present invention.

What I claim is:

1. A casing system for overlapping and covering gaps in vertical interior walls between window elements and structural framing members defining an inward-facing opening for a window and/or between door elements and structural framing members defining an inward-facing opening for a door, the casing system comprising:

a generally flat first casing piece having a top surface, a bottom surface, a pair of linear side edges and a pair of linear end edges, at least one of said linear side edges being provided with a first continuous decorative profile, said first continuous decorative profile having a sloping surface extending from the top surface of the piece to the bottom surface of the piece whereby the width of the top surface is less than the width of the bottom surface, said sloping surface having a non-linear profile with at least two stages wherein one stage has a continuous convex profile; and a pair of second casing pieces, each piece having a top surface, a bottom surface, a pair of linear side edges and a pair of linear end edges wherein at least one of said linear side edges is provided with the first continuous decorative profile and at least one of said linear end edges is provided with a second continuous decorative profile, said second continuous decorative profile being a reverse image of the first continuous decorative profile, said second continuous decorative profile having one stage with a continuous concave profile that is a reverse image of the continuous convex profile;

whereby said first casing piece is joinable to said pair of second casing pieces by abutting engagement of said first continuous decorative profile of said linear side edge of the first casing piece with said reverse image of said second continuous decorative profile on the linear end edge piece of each of the pair of said second casing pieces to form tightly fitted 90° joints between the first casing piece and each piece of the pair of said second casing pieces.

2. The casing system of claim 1, wherein both of said linear side edges of said first piece are provided with said first continuous decorative profile.

3. The casing system of claim 1, wherein both of said end edges of said first piece are provided with said first continuous decorative profile.

4. The casing system of claim 1, wherein both of said linear side edges of said second casing piece are provided with said first continuous decorative profile.

5. The casing system of claim 1, wherein one of said linear end edges of said second casing piece are provided with said second continuous decorative profile.

6. The casing system of claim 1, wherein at least one linear end edge of said first piece is milled with said first continuous decorative profile and the other linear end edge is milled with said second continuous decorative profile.

7. The casing system of claim 1, wherein said first continuous decorative profile comprises a sloping surface extending from said top surface to said bottom surface in at least two stages.

8. The casing system of claim 7, wherein each stage of said sloping surface comprises a profile selected from the group comprising a straight linear profile, a rounded convex profile, and a rounded concave profile.

9. The casing system of claim 1, wherein said top surface of said first casing piece has a decorative structure extending outwardly of said side end edges.

10. The casing system of claim 1, further comprising at least one additional first casing piece.

11. The casing system of claim 1, wherein said top surface of said second casing piece has a decorative structure extending inwardly of said end edges.

12. A casing system for overlapping and covering gaps in vertical interior walls between window elements and structural framing members defining an inward-facing opening for a window and/or between door elements and structural framing members defining an inward-facing opening for a door, the casing system comprising:

a first casing piece having side edges and end edges with a first continuous decorative profile milled into said side and end edges, said first continuous decorative profile having a sloping surface extending from a top surface of the piece to a bottom surface of the piece whereby the width of the top surface is less than the width of the bottom surface, said sloping surface having a non-linear profile with at least two stages wherein one stage has a continuous convex profile;

a pair of first second casing pieces, each piece having side edges and end edges with said first continuous decorative profile milled into the side edges and said second continuous decorative profile, said second continuous decorative profile being a reverse image of the first continuous decorative profile, said second continuous decorative profile having one stage with a continuous concave profile that is a reverse image of the continuous convex profile;

whereby the first casing piece is joinable to the pair of second casing pieces by abutting engagement with the first continuous decorative profile milled into the edges of the first casing piece with the reverse image of said second continuous decorative profile milled into the end edges of each of the second casing pieces to form tightly fitted 90° joints between the first casing piece and each piece of the pair of said second casing pieces.

13. The casing system of claim 12, wherein an end edge of the first casing piece is joinable to an end edge of one of the second casing pieces by abutting engagement of the first continuous decorative profile milled into the end edge of the first casing piece with the reverse image of said second continuous decorative profile milled into the end edge of the second casing piece.

14. The casing system of claim 12, wherein a side edge of the first casing piece is joinable to an end edge of one of the second casing pieces by abutting engagement of the first continuous decorative profile milled into the end edge of the first casing piece with the reverse image of said second continuous decorative profile milled into the end edge of the second casing piece to form a tightly fitted 90° joint between the first casing piece and the second casing piece.

15. A kit of parts forming a casing system for overlapping and covering gaps in vertical interior walls between window elements and structural framing members defining an inward-facing opening for a window and/or between door elements and structural framing members defining an inward-facing opening for a door, the casing system comprising:

at least one generally flat first casing piece having a top surface, a bottom surface, a pair of linear side edges and a pair of linear end edges, at least one of said linear side edges being provided with a first continuous decorative profile, said first continuous decorative profile having a sloping surface extending from the top surface of the piece to the bottom surface of the piece whereby the width of the top surface is less than the width of the bottom surface, said sloping surface having a non-linear profile with at least two stages wherein one stage has a continuous convex profile; and at least a pair of second casing pieces, each piece having a top surface, a bottom surface, a pair of linear side edges and a pair of linear end edges, at least one of said linear end edges being provided with second continuous decorative profile, said second continuous decorative profile being a reverse image of the first continuous decorative profile, said second continuous decorative profile having one stage with a continuous concave profile that is a reverse image of the continuous convex profile; whereby said first casing piece is joinable to each of said second casing pieces by abutting engagement of said first continuous decorative profile of said first casing piece with said reverse image of said second continuous decorative profile of the at least one of the linear end edges of each of said second casing pieces to form tightly fitted 90° joints between the first casing piece and each of the pair of said second casing pieces.

16. The kit of parts of claim 15, including instructions for assembly of the parts to form a casing for overlapping and covering gaps between framing members of a structural opening and vertical walls adjacent to said framing members.

17. The kit of parts of claim 15, further comprising at least one additional first casing piece.

* * * * *